United States Patent [19]

Borgerson, Jr.

[11] 4,180,298

[45] Dec. 25, 1979

[54] RELOCATABLE FURNITURE SYSTEM

[76] Inventor: Newton H. Borgerson, Jr., Anthony Ct., Bethany, Conn. 06525

[21] Appl. No.: 894,721

[22] Filed: Apr. 10, 1978

[51] Int. Cl.[2] ..... A47B 67/02

[52] U.S. Cl. ..... 312/242; 312/246; 312/249

[58] Field of Search ..... 312/245, 242, 246, 249, 312/200, 250, 342

[56] References Cited

U.S. PATENT DOCUMENTS

| | | | |
|---|---|---|---|
| 953,803 | 4/1910 | Sellers | 312/242 |
| 1,380,222 | 5/1921 | Lichtenberg | 312/246 |
| 2,043,779 | 6/1936 | Seifert | 312/242 |
| 2,499,240 | 2/1950 | Aiken | 312/246 |
| 2,578,096 | 12/1951 | Smith | 312/242 |
| 2,841,410 | 7/1958 | Kessler, Jr. et al. | 312/250 |
| 3,257,933 | 6/1966 | Baylinson | 312/242 |
| 3,311,435 | 3/1967 | Heritage | 312/245 |
| 3,317,261 | 5/1967 | Peterson et al. | 312/249 |
| 3,356,434 | 12/1967 | Theodores | 312/250 |
| 3,537,769 | 11/1970 | Carlo | 312/250 |

*Primary Examiner*—Victor N. Sakran
*Attorney, Agent, or Firm*—DeLio and Montgomery

[57] ABSTRACT

A relocatable furniture system where caster mounted cabinets may be rolled into engagement with a wall mounted support rail and releasably captured thereby with the rail supporting the cabinet at its rear from the wall with the cabinet off its rear casters. The front casters are adjustable to level the cabinet.

11 Claims, 8 Drawing Figures

RELOCATABLE FURNITURE SYSTEM

This invention relates to relocatable furniture and more particularly relates to relocatable cabinet-type furniture that may be utilized in a laboratory or similar type working facility.

Initially, furniture such as cabinets with working tops for laboratories were made to fit specific locations and were fastened to the walls and floors. Then, a common counter top of the longest practical length was placed over the base cabinets to provide a permanent installation. As laboratory sciences have become more specialized, the requirement for flexibility and change has become of increasing importance, such as the need to introduce sophisticated pieces of equipment conveniently located for given processes or experiments. The traditional built-in furniture could only be altered by tearing out, redesigning, and reconstructing, which is a costly, time-consuming and inconvenient operation. This led to the demand for flexibility in the location and relocatability of laboratory furniture.

One system that has been proposed and used is a cantilever/suspended system in which a basic supporting structure is installed against a wall mounting and supports counter tops. Cabinets are then suspended from the counter tops. These designs have proven rather expensive and the only flexibility is that of moving and rearranging the actual cabinets under the counters which usually requires the use of dollies or carts. Removal or rearrangement of the counters and supporting structures requires mechanics.

Another approach is that of lightweight wall hung cabinets which are installed on tracks mounted to the walls and module counter tops may be hung by means of snap-in clips. However, this again requires dollies or carts for relocation and special tools are required to relocate the grippers from which the cabinets are hung. Additionally, the depth of drawers and cupboards is very minimal and load bearing capability is limited. More flexible systems, cabinets on casters, have provided the user more flexibility. However, cabinets mounted solely on casters have not been able to cope with the problems of vibration, stability, and uneven floors and have never been provided with an integrated system of mechanical service delivery.

A system as shown in U.S. Pat. No. 3,317,261 permits flexibility in relocation. However, the low point of rear support will make it difficult to easily push the cabinet up the floor mounted support strip. Additionally, for movement, the cabinet must be repositioned on its front casters, which is time consuming.

Accordingly, the present invention provides laboratory furniture which presents the user with an easily movable furniture system. The furniture provides the strength and rigidity of traditional built-in furniture together with the advantage of flexibility. Cabinets embodying the invention may be moved and rearranged without tools or moving dollies and easily leveled regardless of the levelness or lack of levelness of the floor.

Briefly stated, the invention in one form thereof utilizes a horizontal wall mounted support rail which captures the rear of a cabinet and supports it from the wall while retaining the cabinet in a preselected position. The rail has a forward inclined surface leading to a ridge, and a trailing surface falling off behind the ridge. Cooperating means on the rear of the cabinet are arranged to be moved up the forward inclined surface and be captured behind the ridge. This will lift the cabinet off its rear casters and permit it to be located and supported from the wall. The cabinet remains supported at its front on its own casters which are adjustable to level the top of the cabinet. The cabinet may be easily removed by pulling it away from the support rail whereby the cooperating means on the cabinet rides up over the ridge, down the forward inclined surface and drops on its rear casters. Then the cabinet is pushed on its own casters to a new location for similar mounting.

An object of this invention is to provide a new and improved relocatable furniture system.

Another object of this invention is to provide a relocatable counter top furniture system in which the rear of the cabinet is releasably captured on a support rail mounted to a wall, and the front of the cabinet is supported on adjustable casters and in which the cabinet may be easily engaged and disengaged with the support rail.

The features of the invention which are believed to be novel are particularly pointed out and distinctly claimed in the concluding portion of this specification. The invention, however, both as to its organization and operation together with further objects and advantages thereof may best be appreciated by reference to the following detailed description taken in conjunction with the drawings, wherein:

Figure 1:
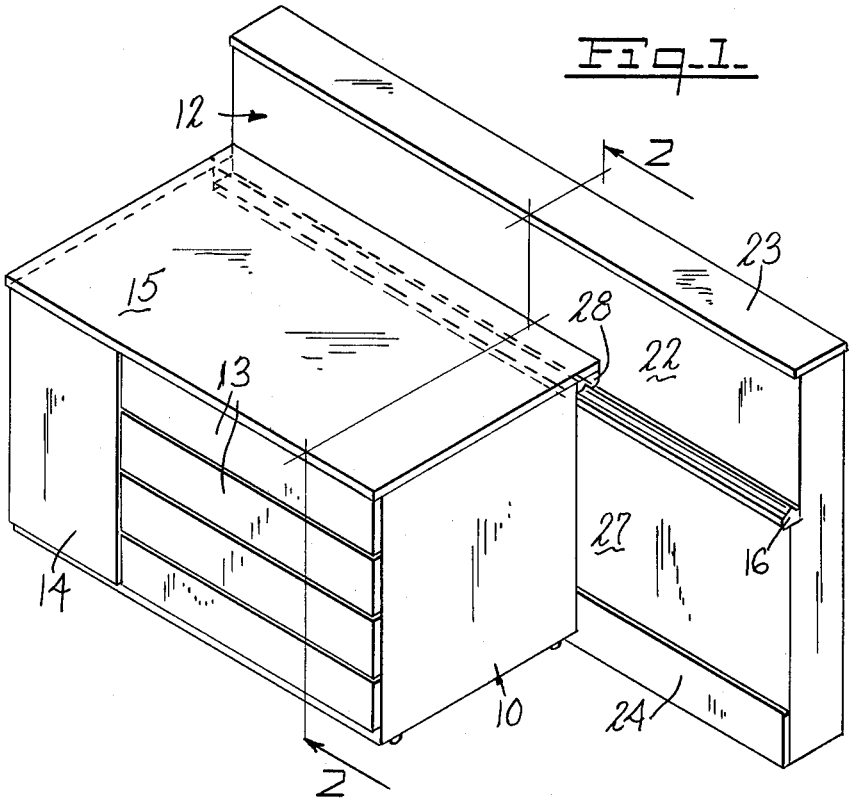
FIG. 1 is a view in perspective of a relocatable cabinet system embodying the invention.
Figure 2:
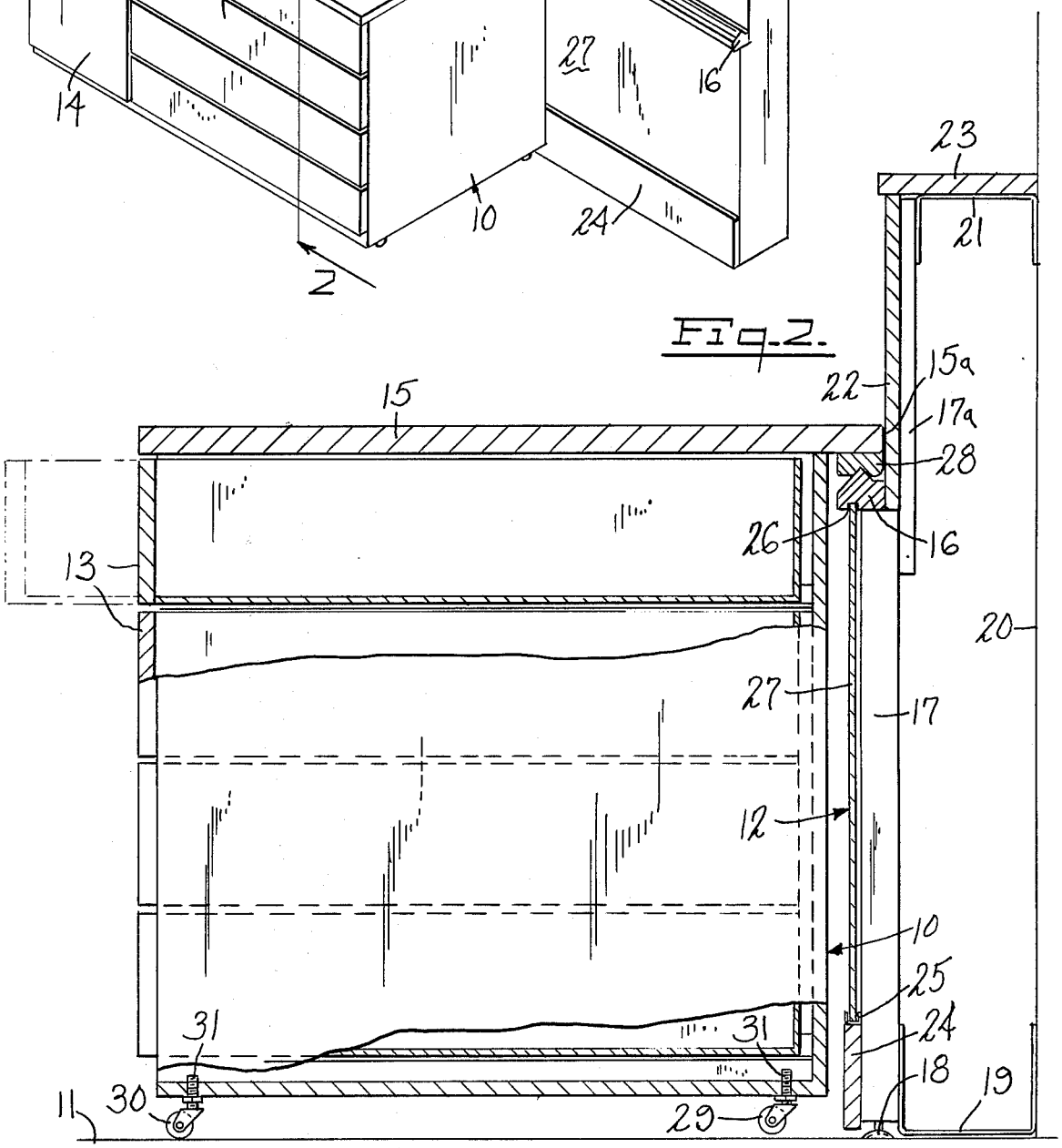
FIG. 2 is a view seen in the plane of lines 2—2 of FIG. 1.

A system embodying the invention, as shown in FIGS. 1 and 2, includes a cabinet 10 which, in an operative position, is partially supported on the floor 11 at the front and from a wall 12 at the rear. The cabinet may take any general configuration and may include drawers 13 and a closed storage area 14 with a counter top 15 mounted thereto. The wall 12 is shown as a partition wall and service strip. Mounted to the wall at a predetermined height above the floor 11 is a support strip or rail 16 which extends along the length of the wall. As mounted to the wall, support strip 16 (see FIG. 3) provides a forward surface **16*a* inclined upwardly towards the wall to a ridge 16*b* and then a rear or trailing surface 16*c*** inclined downwardly from the wall.

The wall structure 12 shown is only exemplary and the rail 16 may be mounted directly to an existing wall. The fabricated partition wall 12, as shown, permits the passage of mechanicals, such as wiring and plumbing, therethrough.

Wall 12 comprises a plurality of spaced apart upright members 17 having adjustable feet 18.

Support member 16 is preferably a continuous length. However, lengths may be butted. Member 16 is secured to the wall in any suitable fashion or, as shown in FIG. 2, may be supported on the uprights 17, or may be initially affixed to facia plate 22.

Uprights 17 are secured at their lower ends to one leg of U-shaped members 19, and the other leg is secured to a wall 20. Extensions **17*a* of uprights 17 are secured to one leg of another U-shaped member 21 whose other leg is secured to wall 20. A face panel 22 to which support rail 16 may be secured extends along and covers upright extensions 17***a*, and a top ledge member 23 covers the assembly.

If desired, the wall assembly 12 may be made free standing and receive cabinets on either side thereof. If no requirement for a service strip is present, support member 16 could be mounted directly to wall 20.

For cosmetic purposes, a baseboard 24 runs along the bottom of uprights 17 and has a small channel 25 thereon which together with a notch 26 in member 16 holds a cover panel 27.

Mounted to the rear of cabinet 10 beneath counter top 15 is a capture member 28 or a spaced plurality thereof having a rear camming surface 28*a* (see FIG. 3) which, as shown, is defined on a radius, and a capture groove 28*b*. Member 28 is mounted at a height in relation to surface 16*a* of support rail 16 such that surface 28*a* will slide up surface 16*a* until ridge 16*b* enters capture groove 28*b*. The pyramidal apex or ridge 16*b* of support member 16 is an essential mate with capture groove 28*b*. The members 16 and 28 are shown slightly separated in FIG. 3 (also FIGS. 4–7) to facilitate identification of surfaces.

It will be understood that member 28 may be continuous along the back of a cabinet 10 or may be individual spaced apart segments.

To initially install a furniture system embodying the invention, the member 16 is mounted to the wall at a predetermined height, usually about twenty-nine inches above the high point of the floor. The cabinet 10 is then moved backwardly toward rail 16, and camming surface 28*a* on member 28 will ride up the inclined leading surface 16*a* until ridge 16*b* is captured in groove 28*b*. Member 28 is positioned and dimensioned with respect to member 16 such that the rear edge 15*a* of counter top 15 is essentially flush or in contact with panel 22. As the rear end of cabinet 10 is captured and supported on rail 16 through member 28, the rear casters 29 of cabinet 10 will be lifted from the floor 11. Then, the front casters 30 are adjusted in height to level the top surface of counter 15. Casters 30 are on threaded shafts 31 received in cabinet 10, and may be vertically adjusted by rotating shafts 31.

With the upper rear of the cabinet supported on the level rail 16, the front casters then give a front two point support to level the counter top regardless of whether the floor is level. The captured support of the rear of the cabinet prevents any movement of the cabinet on its casters from the wall.

Should it at some later time be desired to relocate the cabinet, the cabinet is merely pulled straight out from the wall, or one end is pulled out at a time, at which time surface 28*c* of member 28 will ride up over surface 16*c* of support member 16, the cabinet will drop onto its rear casters 29 and may be pushed to the new location. At the new location the cabinet is again releasably captured and supported on another member 16, and the front casters adjusted to level counter top 15.

Figure 3:
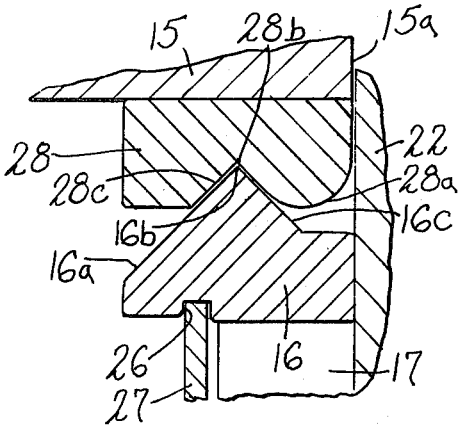
FIG. 3 is an enlarged view of a portion of FIG. 2.
Figure 4:
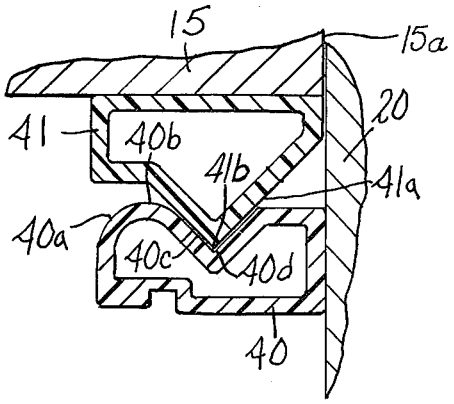
FIGS. 4–7 are views similar to FIG. 3 but illustrating other embodiments of the invention.

FIG. 4 illustrates an alternate embodiment of the invention which is a substantial inversion of the embodiments of FIGS. 1–3. A support rail 40, shown as an extruded length of plastic material, is attached to wall 20 and provides a forward inclined surface which in this case is on a radius 40*a* leading to a ridge 40*b* and a trailing inclined surface 40*c*, and a capture groove 40*d*. Cooperating member 41 on the cabinet, more specifically attached to the underside of counter 15, has a leading surface 41*a* which will ride up on surface 40*a* and over ridge 40*b* and provides an inverted ridge 41*b* which will fall into capture groove 40*d*. With this construction, the rear end of the cabinet will be supported on support rail 40 and releasably captured thereby to maintain the cabinet in a given location on support rail 40. Again, in this embodiment, the inverted ridge 41*b* has a substantially mating cross-sectional configuration with capture groove 40*d*. Additionally, the dimensioning of counter 15 in relation to the positioning of member 41 and support rail 40 is such that the rear surface 15*a* thereof is flush against the wall 20. In FIG. 4, the surfaces have been shown slightly separated for purposes of identification. However, it will be realized that in operation portions of the surfaces of the cooperating members will be flush.

Figure 5:
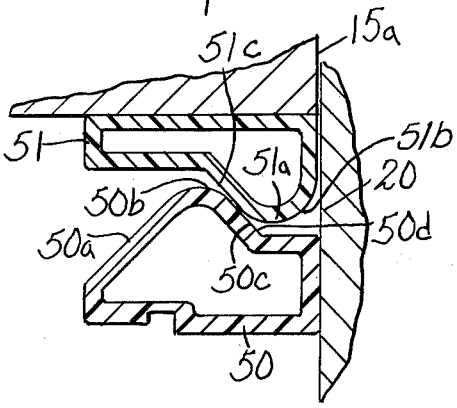

FIG. 5 illustrates another embodiment of the invention wherein a support rail 50 is secured to a wall 20 and provides a forward inclined surface 50*a* leading to a ridge 50*b* and an inclined surface 50*c* therebehind and spaced from wall 20. The cooperating member 51 on the cabinet has a lower projection 51*a* which is received and captured between ridge 50*b* and wall 20 and in supporting contact with support rail 50 along a line or surface 50*d*. The dimensioning of the member 51 with respect to member 50 is such that the rear surface 15*a* of counter 15 will be essentially flush with the back wall 20 and captured between wall 20 and ridge 50*b*. In this embodiment, it will be noted that the projection 51*a*, particularly the portion 51*b* thereof, will have sliding contact upon initial engagement with the inclined surface 50*a* and also the trailing surface 51*c* will have sliding contact with surface 50*d* up to ridge 50*b* should it be desired to move the cabinet from the support rail 50.

Figure 6:
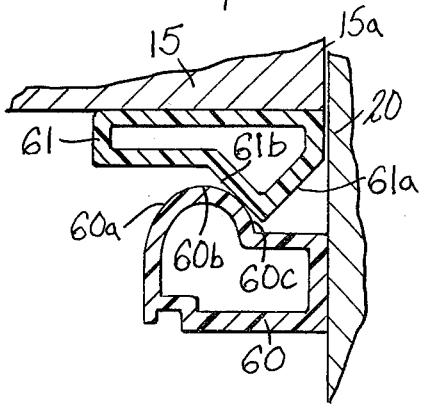

FIG. 6 exemplifies a further embodiment of the invention wherein a support strip 60 is formed with a curved leading surface 60*a* inclined upwardly to a ridge 60*b* and a rear curved surface 60*c* inclined downwardly behind the ridge. The cooperating member 61 on the cabinet has an essentially triangular cross-sectional configuration with a leading edge 61*a* which will slide over surface 60*a* and ridge 60*b* and be captured therebehind between surface 60*c* and wall 20. If it should be desired to relocate the cabinet, the surface 61*b* of member 61 may be pulled outwardly with the cabinet and slide over surface 60*c* and ridge 60*b* until the cabinet drops onto its rear casters ready for relocation.

Figure 7:
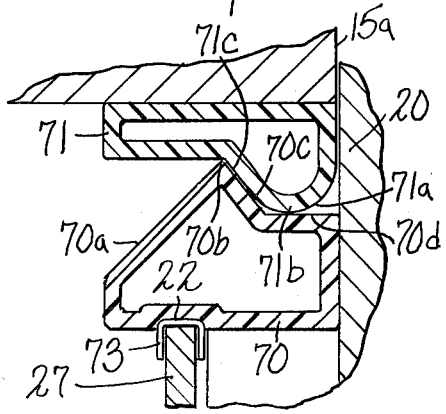

FIG. 7 exemplifies another embodiment of the invention having a support rail 70 with a leading surface 70*a* inclined to ridge 70*b*. Trailing surface 70*c* is inclined downwardly. Cooperating member 71 has a leading curved surface 71*a* adapted to slide up surface 70*a*. A depending ridge 71*b* of member 71 is dimensioned to rest on surface 70*d* and surface 71*c* contacts surface 70*c*. The depending ridge is captured between ridge 70*b* and wall 20. Here member 70 is formed with a groove 72 to receive a small channel 73 which in turn may receive cover panel 27.

Figure 8:
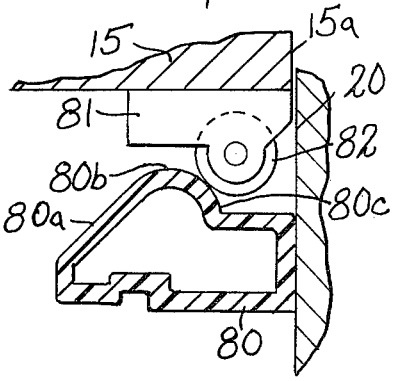
FIG. 8 is a view similar to FIG. 5 but showing a still further embodiment of the invention.

Another embodiment of the invention is shown in FIG. 8 which includes a support rail 80 similar to the support rail 50 of FIG. 5 where the support rail has a forward inclined surface 80*a* leading to a ridge 80*b* and a trailing downwardly inclined surface 80*c*. Cooperating members 81, preferably two in number, are positioned at either edge of the counter 15. The members 81 include a rotatably mounted wheel 82 adapted to roll up surface 80*a* and be captured on surface 80*c* behind the ridge 80*b* with the rear edge of the counter 15*a* in contact with wall 20.

To relocate the cabinet, a forward pull is exerted on the counter 15 to cause wheels 82 to roll up over ridge **80*b* and down surface 80*a*** and drop the cabinet on its rear casters.

It will be apparent that other structural arrangements embodying the invention may be provided. All that is necessary is a ridge on the support rail over which the rear of the cabinet may move and be captured therebehind to support the rear of the cabinet on the wall. Thereafter, the front casters may be adjusted in height to provide the necessary leveling in accordance with the contour of the floor.

It may thus be seen that the objects of the invention set forth as well as those made apparent from the foregoing description are efficiently attained. While preferred embodiments of the invention have been set forth for purposes of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A relocatable furniture system comprising, at lease one piece of furniture, a wall mounted horizontal support rail, said rail extending from a wall and having elongated leading and trailing inclined surfaces, said surfaces defining a first ridge therebetween spaced from the wall, said piece of furniture having front and rear rollable support casters and having a rear extension toward the top thereof, a member having a depending ridge on said extension at a height which abuts said leading surface and which will depend behind said first ridge in contact with said trailing surface whereby said cabinet may be moved on its casters against said support rail and said member will ride up said inclined leading surface and said depending ridge will depend behind said first ridge so that the rear of said piece of furniture is releasably captured by said rail and supported thereon with the rear casters above the floor, said front casters being adjustable in height to level said piece of furniture.

2. The system of claim 1 wherein said rail is mounted to a wall, said piece of furniture has a counter top providing said rear extension, said member mounted below said counter top extension, said member and said counter top being dimensioned such that the rear edge of said counter top abuts said wall.

3. The system of claim 2 wherein said depending ridge on said member comprises a rotatable member.

4. The system of claim 1 wherein said member has a groove arranged to capture the ridge of said rail therein.

5. The system of claim 1 wherein said rail has a groove therein defined behind its ridge arranged to capture the depending ridge of said members therein.

6. The system of claim 4 wherein said ridge of said rail member is defined as an apex with planar leading and trailing surfaces.

7. The system of claim 5 wherein said depending ridge is defined as an apex with planar leading and trailing surfaces.

8. The system of claim 1 where said rail has leading and trailing planar inclined surfaces defining said first ridge, said member has a curved surface arranged to abut and ride up said leading surface and over and behind said first ridge, said piece of furniture having a counter top with a rear edge, said rail and said member being dimensioned such that said rear edge abuts the wall and said depending ridge is captured between said first ridge and the wall with said rear edge abutting the wall.

9. The system of claim 1 wherein the leading surface of said rail is planar.

10. The system of claim 1 wherein the leading surface of said member is planar.

11. The system of claim 9 wherein the leading and trailing surfaces defining a depending ridge on said member are defined at least partially on a radius.

* * * * *